US005619769A

United States Patent [19]

Hutt

[11] Patent Number: 5,619,769

[45] Date of Patent: Apr. 15, 1997

[54] PAINT ROLLER BEARING SUPPORT ASSEMBLY

[76] Inventor: Heinz Hutt, 9140 Cérès, Pierrefonds (Québec), Canada, H3Y 3N7

[21] Appl. No.: 352,139

[22] Filed: Dec. 1, 1994

[51] Int. Cl.[6] ..... B05C 17/02

[52] U.S. Cl. ..... 15/230.11; 401/197; 401/208; 492/13; 492/19

[58] Field of Search ..... 15/230.11; 401/197, 401/208; 492/13–19

[56] References Cited

U.S. PATENT DOCUMENTS

| | | | |
|---|---|---|---|
| 3,638,271 | 2/1972 | Pharris et al. | 15/230.11 |
| 3,711,887 | 1/1973 | Chapman | 15/230.11 |
| 3,803,682 | 4/1974 | Stein | 492/16 |
| 4,295,241 | 10/1981 | Woolcock | 15/230.11 |
| 4,316,301 | 2/1982 | Smith et al. | 15/230.11 |
| 4,985,959 | 1/1991 | Lieberman et al. | 15/230.11 |
| 5,490,303 | 2/1996 | Graves | 15/230.11 |

FOREIGN PATENT DOCUMENTS

| | | | |
|---|---|---|---|
| 389357 | 9/1990 | European Pat. Off. | 15/230.11 |
| 3410468 | 9/1985 | Germany | 15/230.11 |

*Primary Examiner*—Gary K. Graham

[57] ABSTRACT

The paint roller bearing support assembly is for use with a paint roller. The roller bearing support assembly comprises a tubular sleeve, defining a generally cylindrical main body circumscribing an inner cylindrical channel, with the channel sized for through-engagement by the shaft in friction-fit interlock fashion. A cylindrical end cap roller is also provided, defining a cylindrical outer wall member, sized to fit within the cylindrical paint roller in friction fit fashion, and a cylindrical inner wall, for surrounding said shaft. A pair of closely spaced annular ribs are provided radially outwardly from the sleeve, wherein the annular cavity formed therebetween is releasably engaged by a flange depending radially inwardly from the end cap roller inner wall. Hence, axial displacement of the bearing relative to the shaft is prevented. This support assembly is thus adaptable to paint rollers of different lengths.

8 Claims, 3 Drawing Sheets

PAINT ROLLER BEARING SUPPORT ASSEMBLY

FIELD OF THE INVENTION

This invention relates to tools for painters.

BACKGROUND OF THE INVENTION

A conventional paint roller system consists of a shaft carried by a handle via an elbowed arm. Cylindrical bearings anchor at both ends of the shaft the opposite ends of a few, e.g. four spring-biased axial rods that are outwardly bent. A hollow cylindrical paint roller is axially engageable along the shaft, whereby a friction fit interlock occurs between the spring-biased tension rods and the inner face of the cylindrical paint roller. The end bearings also enable free rotation of the paint roller around the shaft.

A first problem with such conventional paint rollers is that, because of the need to anchor the tension rods to the shaft end bearings, a shaft of a given length can accommodate only a single length of paint roller. That is to say, the paint roller system is not versatile. A second problem is that the outwardly biased tension rods have a tendency to burst the cardboard sheet backing of the cylindroid hollow paint roller, particularly after repeated use of the paint roller, wherein the paint roller becomes unusable.

OBJECTS OF THE INVENTION

The gist of the invention is to therefore address the problem outlined in the background of the invention paragraph, by providing an improved paint roller bearing system that will be able to accommodate paint rollers of different lengths.

A corollary object of the invention is to improve convenience of use and reduce expenses for painting jobs.

An important object of the invention is to extend the useful lifetime of the paint roller.

SUMMARY OF THE INVENTION

According to the invention, there is disclosed a paint roller bearing support assembly for use with a paint roller, the paint roller of the type having a handle-carried straight shaft and a cylindrical paint roller to be carried coaxially around the shaft, said roller bearing support assembly comprising: (a) a tubular clamping bearing sleeve member, defining a generally tubular main body circumscribing an inner tubular channel member; said channel member sized for axial through-engagement therein by said shaft in releasable friction-fit interlock fashion; (b) an end cap roller member, defining a cylindrical outer wall member, sized to fit within said cylindrical paint roller in releasable friction fit fashion, and a tubular inner wall member, for freely surrounding said shaft; and (c) means for interconnecting in freely rotating fashion said end cap roller member inner wall member and said clamping bearing sleeve member whereby axial displacement of the former relative to the latter is prevented; wherein said roller bearing support assembly is adaptable to paint rollers of different lengths, and is for use as a pair of roller bearing support assemblies at the opposite end portions of the paint roller shaft.

According to one embodiment of said end cap roller member\clamping bearing sleeve member interconnecting means, it is releasable and includes: (a) a pair of closely spaced circumferential ribs which radially outwardly depend from an intermediate section of said clamping bearing sleeve member main body integrally thereof, whereby an annular cavity is defined therebetween, said ribs being diametrally smaller than the internal diameter defined by said inner wall member of said end cap roller member; and (b) a flange which radially inwardly depends from one end of said inner wall member of the end cap roller member, wherein said flange releasably engages said annular cavity. Preferably, there is provided additional circumferential ribs, provided in axially spaced successive positions, said additional ribs for free engagement with said end cap roller inner wall in axially spaced fashion for maintaining axial alignment of the shaft relative to said end cap roller member. Means for facilitating engagement of said lip into said annular cavity could also be envisioned; these facilitating means would then include: (a) the formation of a plurality of bores in said main body of the clamping bearing sleeve member, whereby a latticed half portion of said clamping bearing sleeve member is achieved; and (b) the selection of a sturdy resilient material for the constituting material of said clamping bearing sleeve member main body.

It is envisioned to provide axial ribs carried by said end cap roller outer wall member radially outwardly therefrom, said axial ribs for friction-fit interlock between said end cap roller member and said cylindrical paint roller. These axial ribs could be of a cross-sectional shape chosen from the group comprising: V-shape and U-shape.

Preferably, there is provided means for facilitating shaft engagement through said channel member of the clamping bearing sleeve member, while not compromising the friction fit interlock capability of said channel member. These facilitating means could include: (a) an elongated axial slit made about an end portion of the main body of said clamping bearing sleeve member; and (b) the selection of a sturdy resilient material for the constituting material of said clamping bearing sleeve member main body.

According to a second alternate embodiment of the end cap roller member\clamping bearing sleeve member interconnecting means, there would be provided: (a) a pair of closely spaced circumferential ribs which radially outwardly depend from an intermediate section of said clamping bearing sleeve member integrally thereof, whereby an annular cavity is defined therebetween, said ribs being diametrally smaller than the internal diameter of said inner wall member of said end cap roller member; (b) a pair of closely spaced axial notches at an end portion of said end cap roller inner wall, whereby an axial finger is formed between said notches, said finger including a radially downwardly depending lip; and (c) the selection of a sturdy resilient material for the constituting material of both said end cap roller member and said clamping bearing sleeve member; wherein said lip releasably engages said annular cavity of the clamping bearing sleeve member. Means for facilitating engagement of said flange into said annular cavity could then be envisioned, including: (a) the formation of a plurality of bores in said main body of the clamping bearing sleeve member, whereby a latticed half portion of said clamping bearing sleeve member is achieved; and (b) the selection of a sturdy resilient material for the constituting material of said clamping bearing sleeve member main body.

Preferably, said end cap roller member is substantially shorter than said clamping bearing sleeve member.

Still another alternate embodiment of end cap roller member\clamping bearing sleeve member interconnecting means could include: (a) a few notches, made axially at one end portion of said main body of the clamping bearing sleeve member; (b) the selection of a sturdy, resilient material for the constituting material of said clamping bearing sleeve member main body; (c) a first circumferential rib which radially outwardly depend from an intermediate section of said clamping bearing sleeve member main body; and (d) a second circumferential rib which radially outwardly depend from the end of said notched end portion of clamping bearing sleeve member, said second rib being also notched, whereby said inner wall member of the end cap roller member is sized to rotatably fit between said first and second ribs of the clamping bearing sleeve member while axial movement of the clamping bearing sleeve member relative to the end cap roller member is substantially prevented.

DETAILED DESCRIPTION OF THE DRAWINGS

Figure 1:
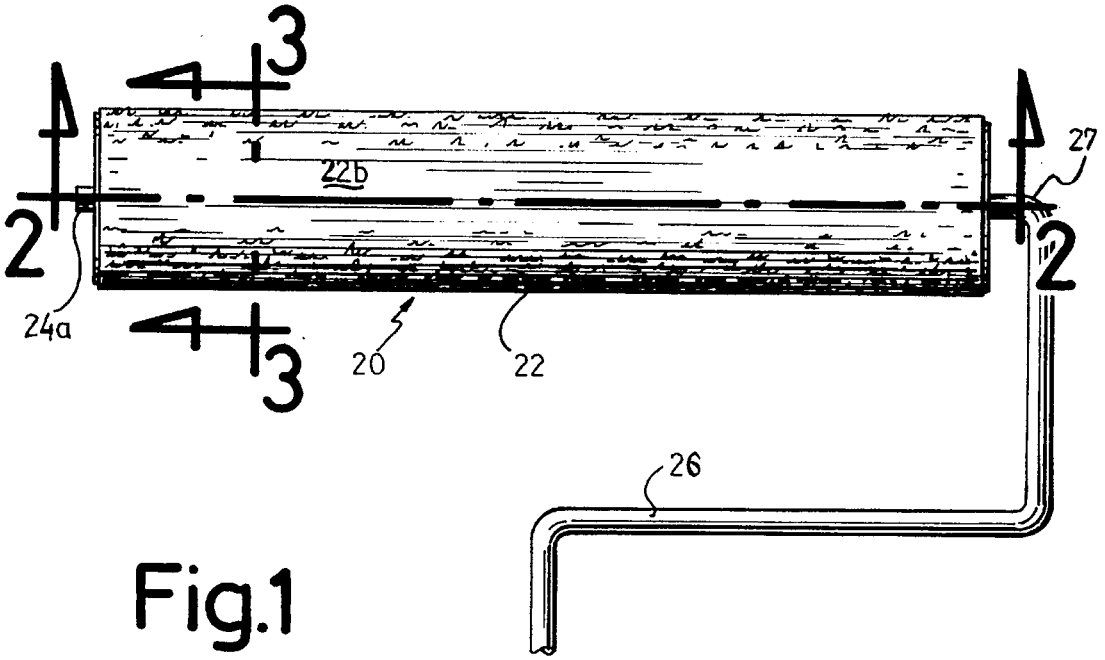
FIG. 1 is a partly broken plan view of a paint roller, with the handle removed.
Figure 2:
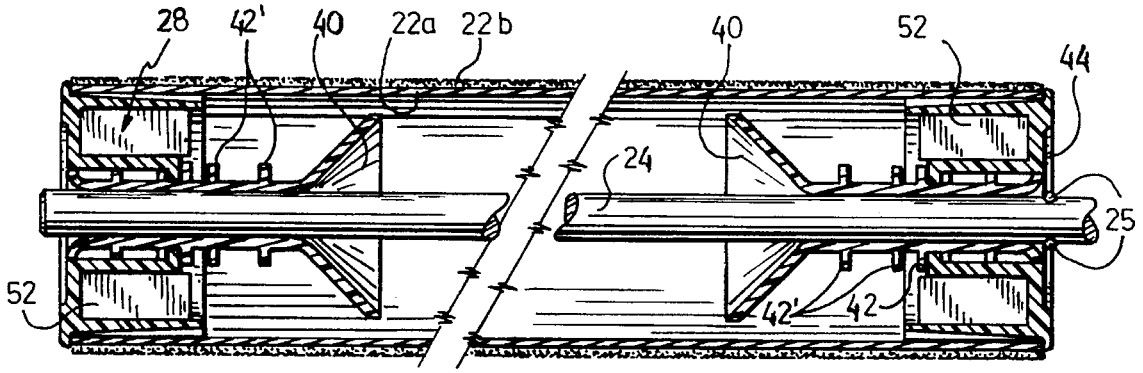
FIGS. 2 and 3 are a sectional view and a cross-sectional view, respectively, of FIG. 1, but at a larger scale and with FIG. 2 being broken for clarity of the view.
Figure 3:
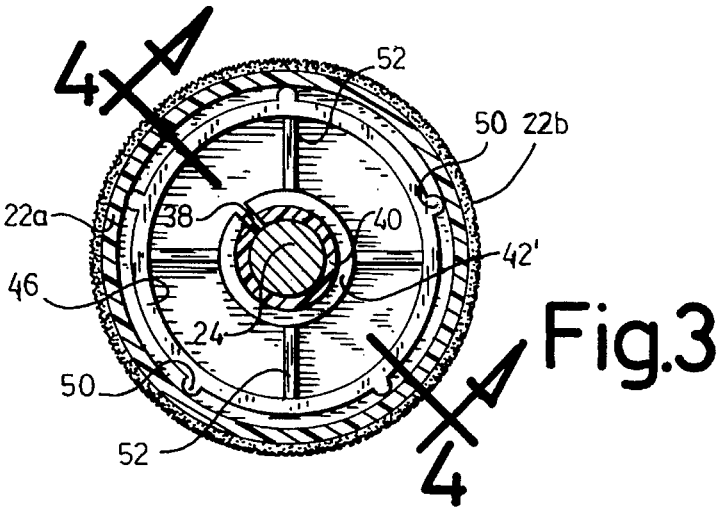

The paint roller 20 of FIG. 1 consists of a cylindrical hollow paint roller 22, rotatably mounted around an inner shaft 24, with shaft 24 being endwisely carried at one end by a transverse handle (not shown) via an elbowed arm 26. The paint roller 22 conventionally consists of a radially inward cylindrical cardboard backing 22*a*, which supports a radially outward, cylindrical fabric sheet 22*b*. Paint roller 22 is releasably anchored to the shaft 24 by a pair of anchoring means 28, each located at a respective end portion of the shaft 24.

Figure 4:
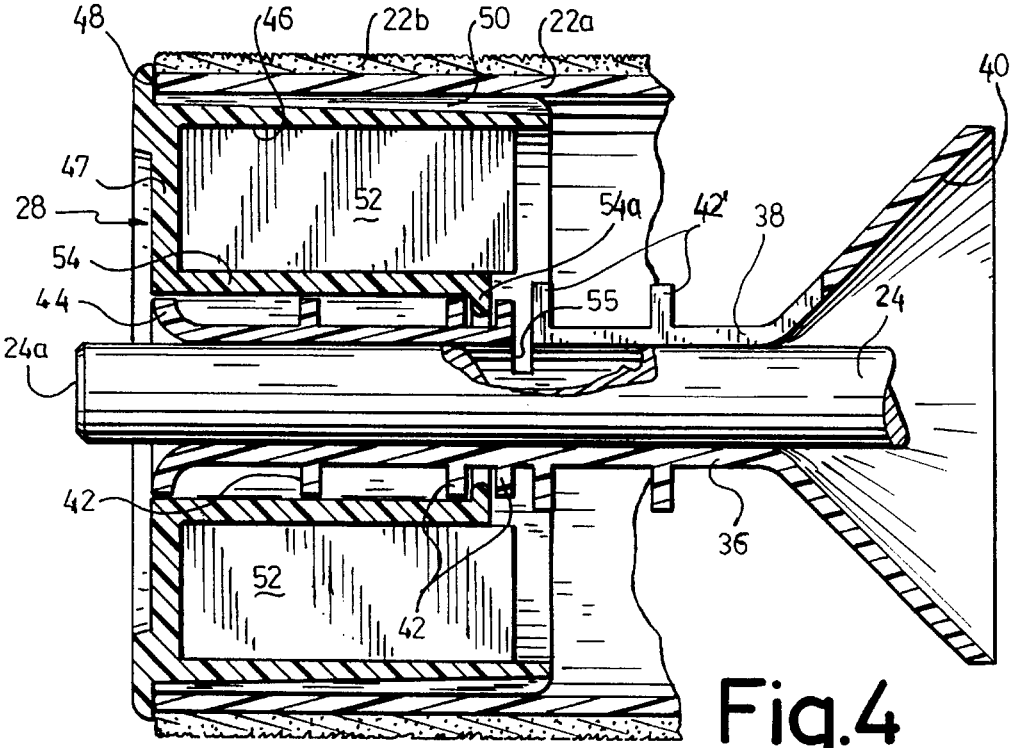
FIG. 4 is a partial sectional view at a still enlarged scale taken along line 4—4 of FIG. 3.
Figure 5:
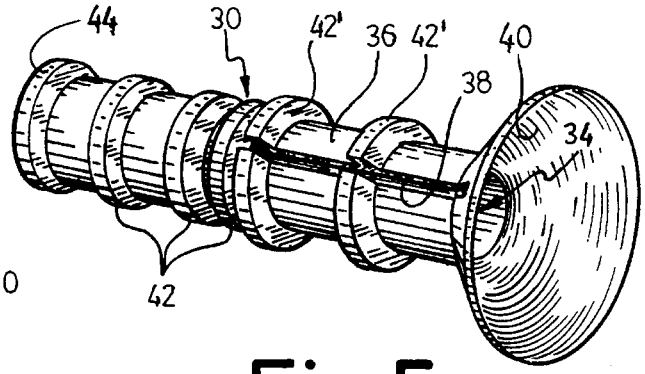
FIG. 5 is an isometric view of a first embodiment of clamping bearing sleeve member according to the invention.
Figure 6:
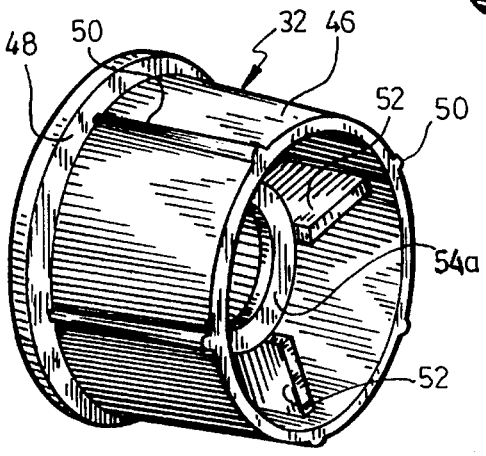
FIG. 6 is an isometric view of one of the two end cap rollers of the paint roller.

In accordance with a first embodiment of paint roller anchoring means, 28, illustrated in FIGS. 2–6 of the drawings, and particularly in FIGS. 5 and 6, there are provided, at each end portion of the shaft 24, an cylindroid, partly slitted tubular clamping bearing sleeve member 30, and a cylindroid end cap roller 32. Clamping bearing sleeve 30 is axially longer and diametrally much smaller than end cap roller 32 . Clamping bearing sleeve 30 is hollow so as to define a cylindrical inner channel 34 having a diameter complementary to that of the shaft 24, so that a friction fit interlock occurs between shaft 24 and clamping bearing sleeve 30 upon shaft 24 engaging axially into and through channel 34.

To facilitate axial engagement of clamping bearing sleeve 30 through the end 24*a* of shaft 24, a fraction of the axial length—e.g. half of the length—of the cylindrical wall 36 of clamping bearing sleeve 30, is slitted at 38, starting with a diametrally enlarged or flared end mouth 40 of clamping bearing sleeve 30. By forcibly expanding the slitted wall portion 36, e.g. manually, the slit 38 opens slightly, thus facilitating through passage of the shaft 24 through the inner channel 34 of clamping bearing sleeve 30.

A number of axially spaced, annular ribs 42, 42', are formed on the diametrally external face of the clamping bearing sleeve 30, with ribs 42 being on the unslitted portion of clamping bearing sleeve 30 while ribs 42' are on the slitted portion of clamping bearing sleeve 30 (annular ribs 42' are also slitted, of course). Preferably, the end 44 of clamping bearing sleeve 30 opposite mouth 40 is also flared outwardly. Preferably also, the flaring of mouth 40, 44, form radially outwardly projecting annular ribs.

As clearly shown in FIG. 4 of the drawings, radially outturned mouth rib 44 has the smallest external diameter; radially outturned slitted mouth rib 40, the largest external diameter (to facilitate through passage of rod 24); and annular ribs 42 and annular ribs 42', an external diameter intermediate ribs 40 and 44. Also, each rib 40, 42, 42', 44, should preferably be of cross-sectionally U-shape.

It is understood that slit 38 and mouths 40, 44, facilitate forcible sliding motion of shaft 24 through the clamping bearing sleeve inner channel 34, without compromising the (releasable) friction fit interlock capability therebetween (due to the resiliency of the constituting material of the clamping bearing sleeve member 30).

End cap roller member 32 includes a rigid cylindrical main body 46, having a radially outturned flange 48 at one end and a number of radially outward axial lips 50. Preferably, lips 50 are cross-sectionally V-shape (see FIG. 6) or U-shape (see FIG. 7). Lips 50 and the cylinder paint roller cardboard backing 22*a* are of complementary diameters, whereby releasable friction fit interlock occurs therebetween upon engagement of cylindrical body 46 within the cylindrical hollow of paint roller 22. Flange 48 is diametrally larger than cylindrical cardboard backing 22*a*, so as to axially abut endwisely thereagainst when end cap roller 32 is fully inserted into paint roller 22 (see FIG. 4).

Body 46 preferably carries a few integral, radially inturned, spaced, axially extending, rectangular spacer wings 52. (Wings 52 reduce weight, compared to a full end cap roller) A cylindrical body 54 is anchored to the radially inner edges of wings 52, whereby cylinders 46 and 54 are coaxial. Preferably, cylinders 46 and 54 are joined at their outer ends by an annular wall 47, with the radially outward end mouth flaring 44 coming flush with wall 47 in freely sliding fashion relative thereto. The inner end of radially inward cylinder 54 extends short of the corresponding inner end (opposite the flanges 48) of radially outward cylinder 46, and includes a radially inturned lip 54*a*. As suggested in FIG. 4, lip 54*a* has preferably a rounded contour in cross-section, defines an internal diameter smaller than the external diameter of lips 42, and is freely engageable between two closely spaced annular lips 42, 42, as illustrated, whereby bodies 36 and 46 become permanently interconnected in freely rotating fashion relative to one another. Hence, the bearing action of body 46 around body 36 enables free rotation of paint roller 22*b* relative to coaxial shaft 24.

This interlocking of elements 30 and 32 may be done during manufacture thereof, or alternately, could be done preferably by the customer himself. When done by the customer himself, there should be provided means for facilitating engagement of flange 54*a* between the two closely spaced lips 42; such means would preferably be a notch 55 (FIG. 4) made tangentially of wall 36, at a location intermediate the innermost lip 42 and the innermost lip 42' and proximate the annular cavity formed by the two closely spaced lips 42, 42, into which the flange 54*a* will fit. Notch 55 enables slight, forcible, transverse flexing of the resilient tubular body 36 relative to its longitudinal axis, just enough to bring said two closely spaced lips 42, 42, to clear lip 54*a* for engagement of the latter therebetween.

The remaining annular lips 42, as well as the mouth flange 44, provide rib support for cylinder body 54, to prevent accidental axial tilt of shaft 24 relative to paint roller 22.

It can now be understood that, while the position of body 32 relative to body 30 remains fixed, the combined elements 30 and 32 are releasably slidingly engageable along shaft 24, to releasably fit paint roller shafts 24 of different lengths; the radially outturned flange 48 being brought to its endwisely abutting operative position against the end of cardboard backing 22*a*, as illustrated in FIG. 4. With the present invention, the radially outturned lips 50 of body 32 should not damage the cardboard 22*a*, even after repeated uses (i.e. after repeated release and reengagement of the combined unit 30–32 from into the paint roller). The material of bodies 30, 32, should be sturdy, yet have some resiliency—a plastic such as Polyvinyl Chloride would be preferred.

Figure 8:
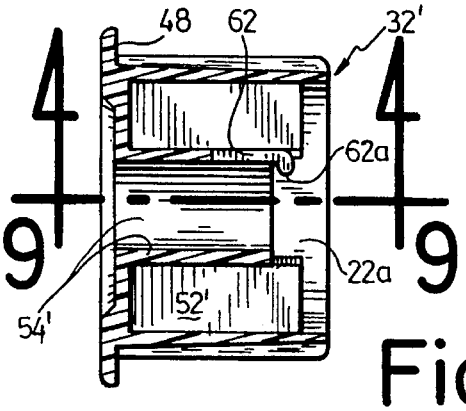
FIG. 8 is a cross-section about line 8—8 of FIG. 7.
Figure 7:
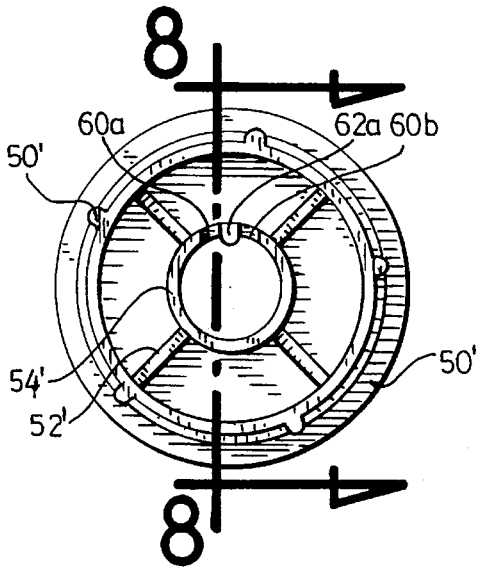
FIG. 7 is an inner end view of an alternate embodiment of one end cap roller.
Figure 9:
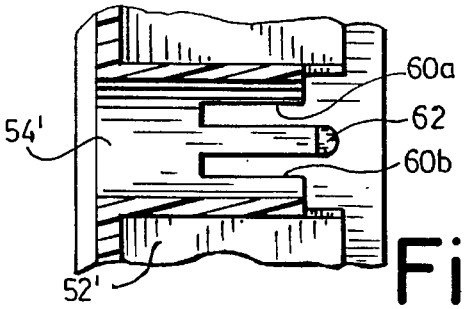
FIG. 9 is a sectional view along line 9—9 of FIG. 8.

In the alternate embodiment of cylinder body 32', illustrated in FIGS. 7–9 of the drawings, reference numerals corresponding to those of the first embodiment are primed. As best seen in FIG. 9, the radially inner cylinder sheath 54' is characterized in that there is provided a pair of closely spaced, elongated, axial notches 60*a*, 60*b*, at the inner end thereof, whereby an axial finger 62 is formed therebetween. Finger 62 carries a radially inturned rounded lip 62*a* at its free inner end. This lip 62*a* replaces ring 54*a* (of the first embodiment) as a means for interconnecting elements 30 and 32', by engaging—as was the case for rings 54*a*—the annular cavity formed by said two closely spaced lips 42, 42, of the tubular clamping bearing sleeve member 30. Ribs 50' of body 32' may be rounded, instead of V-shape, in cross-section, relative to the first embodiment of body 32.

Figure 10:
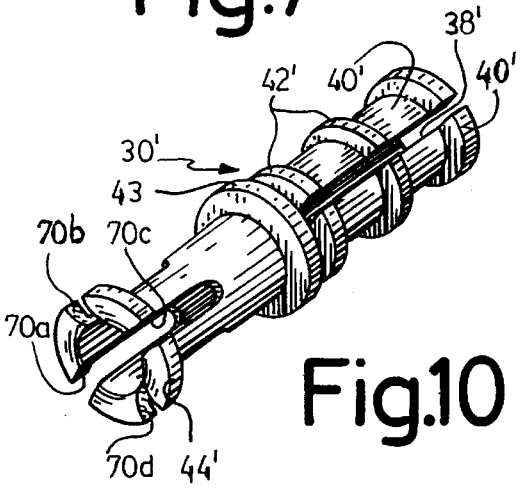
FIG. 10 is an isometric view of another embodiment of clamping bearing sleeve member according to the invention.
Figure 11:
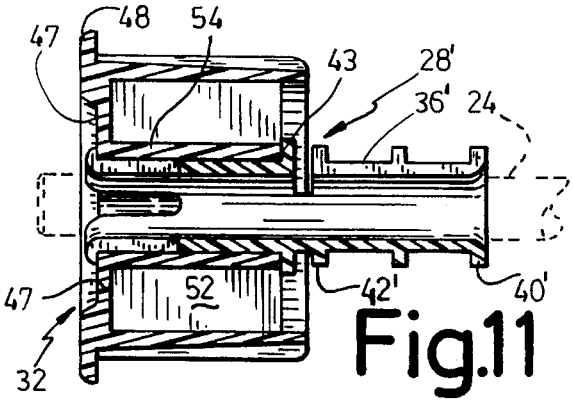
FIG. 11 is a view similar to that of FIG. 4, but at a smaller scale and showing the embodiment of clamping bearing sleeve member of FIG. 10.

FIG. 10 shows an alternate embodiment of clamping bearing sleeve element 30' (all corresponding parts thereof corresponding to the first embodiment being primed). In this embodiment, the slitted half-portion of the clamping bearing sleeve 30' is the diametrally smallest, including the same annular ribs 42' and flared end mouth 40'; whereas the other half-portion of the clamping bearing sleeve 30' now includes four equidistant axial notches 70*a*, 70*b*, 70*c*, and 70*d*, about the outer free end thereof, but lacks annular ribs along its length except an innermost annular rib 43. Notches 70*a*–70*d* open into and through mouth flaring 44'. By virtue of these axial notches 70*a*–70*d*, and of the resiliency of the material constituting clamping bearing sleeve member 30', it is possible—as suggested in FIG. 11—to engage clamping bearing sleeve member 30' endwisely through the cylindroid channel formed by the inner cylinder body 54 of end cap roller member. Such engagement of clamping bearing sleeve member 30' is made simply by forcibly drawing toward one another the four axial legs formed between each pair of successive notches 70*a*–70*d*, whereby the external diameter of mouth flaring 44' of clamping bearing sleeve member 30' becomes temporarily smaller than the internal diameter of cylinder body 54 of end cap roller 32; this in turn enables through-passage of the clamping bearing sleeve member 30 into the cylinder body 54, until annular rib 43 reaches and abuts against the inner end edge of cylindrical body 54. Preferably, the length of the unslitted portion of clamping bearing sleeve element 30' is such that, as annular rib 43 reaches the inner end edge of cylindrical body 54, mouth flaring 44' comes to abut against the end cap roller end wall 47.

Figure 13:
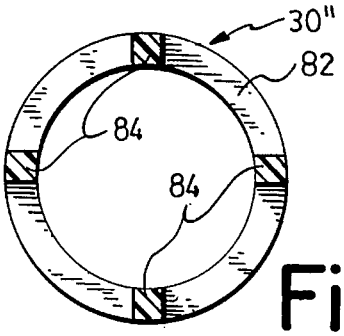
FIG. 13 is a cross-section about line 13—13 of FIG. 12.
Figure 12:
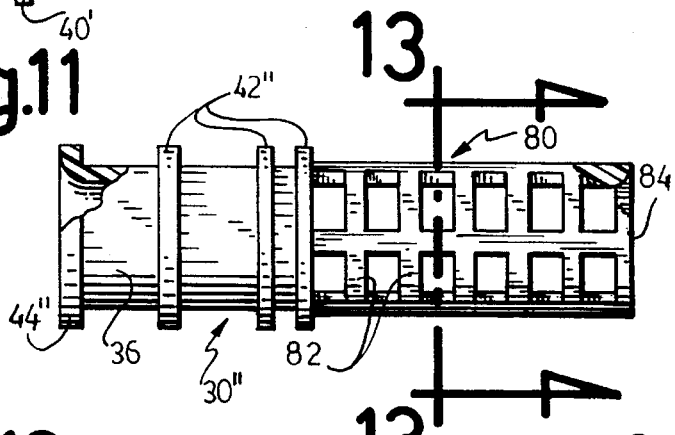
FIG. 12 is still another embodiment of clamping bearing sleeve member according to the invention, where said clamping bearing sleeve member and end cap roller are integral to one another.

The last embodiment of clamping bearing sleeve member is illustrated in FIGS. 12–13 and referenced 30". Corresponding reference numerals are double primed. Clamping bearing sleeve member 30" is similar to the first embodiment illustrated in FIG. 5, except that the slitted half-portion of the first embodiment has been replaced by a generally open, latticed, tubular portion 80. Latticed tubular portion 80 consists of a plurality of spaced circumferential first strips 82, and a few—e.g. four as in the drawings—equally spaced axial strips 84. Again, by virtue of the voids in the wall of tubular portion 80, a collapsible structure is obtained. Such collapsible tubular portion 80 will facilitate engagement of ring 54a (or lip 62a) from the end cap roller 32 (32'), due to the resilient material used for portion 80, simply by forcibly compressing portion 80 proximate said two closely spaced annular ribs 42", 42", whereby ring 54*a* or lip 62*a* will more easily engage into the annular cavity formed between said pair of successive closely spaced annular ribs 42", 42". Latticed portion 80 will also facilitate through-passage of shaft 24 therein, in a releasable friction-fit interlocking fashion.

It is understood that the means for rotatably interlocking the end cap roller 32 to the clamping bearing sleeve 30 (i.e., notches 70*a*70*d* and ribs 43, 44' in the embodiment of FIG. 10; lip 62*a* and two closely spaced intermediate ribs 42, 42, in the embodiment of FIGS. 4 and 8; or flange 54a and the two closely spaced intermediate ribs 42, 42, in FIGS. 4–6) substantially prevent accidental axial displacement of the end cap roller 32 relative to the clamping bearing sleeve 30. That is to say, some minor axial play could remain while this bearing system would still remain fully operational. The important consideration is that this axial play should not be such as to allow the end cap roller 32 to fall off from the shaft 24 of the paint roller.

It is to be noted that the present invention is not to be limited solely to the embodiments illustrated in the drawings. Various other paint roller systems according the invention should be considered to be encompassed within the scope of the present invention. For example, in an alternate embodiment of the invention (not illustrated in the drawings), it could be envisioned to have two interlocking cylinders, with the help of a groove on the interior cylinder, and of a rib on the exterior cylinder.

I claim:

1. A paint roller bearing support for use with a paint roller assembly, the paint roller assembly having a handle-carried straight shaft and a cylindrical roller to be carried coaxially around the shaft, said roller bearing support comprising:

(a) a tubular clamping bearing sleeve member, defining a generally tubular main body circumscribing an inner tubular channel, said tubular main body sized for axial through-engagement therein by said shaft in releasable friction-fit interlock fashion;

(b) an end cap roller member, defining a cylindrical outer wall member, sized to fit within the cylindrical paint roller in releasable friction fit fashion, and a tubular inner wall member, for freely surrounding said shaft; and (c) means for interconnecting in freely rotating fashion said end cap roller member inner wall member and said clamping bearing sleeve member whereby axial displacement of the former relative to the latter is prevented; wherein said paint roller bearing support is adaptable to paint rollers of different lengths, and is for use at one of opposite end portions of the paint roller shaft; wherein said interconnecting means is releasable and includes:

(i) a pair of closely spaced circumferential ribs which radially outwardly depend from an intermediated section of said clamping bearing sleeve member main integrally thereof, whereby an annular cavity is defined therebetween, said ribs being diametrally smaller than the internal diameter defined by said inner wall member of said end cap roller member; and (ii) a flange which radially inwardly depends from one end of said inner wall member of the end cap roller member, wherein said flange releasably engages said annular cavity.

2. A paint roller bearing support as defined in claim 1, wherein said sleeve member further includes additional circumferential ribs, provided in axially spaced successive positions, said additional ribs for free engagement with said end cap roller member inner wall in axially spaced fashion for maintaining axial alignment of said shaft relative to said end cap roller member.

3. A paint roller bearing support as defined in claim 1, wherein said sleeve member further includes means for facilitating shaft engagement through said channel thereof, while not compromising the friction fit interlock capability of said tubular main body.

4. A paint roller bearing support as defined in claim 3, wherein said facilitating means includes:

(a) an elongated axial slit made about an end portion of the main body of said clamping bearing sleeve member; and (b) said clamping bearing sleeve member main body being made of a sturdy resilient material.

5. A paint roller bearing support assembly as defined in claim 1, wherein said interconnecting means further includes:

(a) a pair of closely spaced axial notches at an end portion of said end cap roller inner wall, whereby an axial finger is formed between said notches, said finger supporting said flange; and (b) both said end cap roller member and said clamping bearing sleeve member being made of a sturdy resilient material.

6. A paint roller bearing support assembly as defined in claim 5, further including means for facilitating engagement of said flange into said annular cavity, said facilitating means including:

(a) formation of a plurality of bores in said main body of the clamping bearing sleeve member, whereby a latticed half portion of said clamping bearing sleeve member is achieved; and (b) said clamping bearing sleeve member main body being made of sturdy resilient material.

7. A paint roller bearing support assembly as defined in claim 1, further including means for facilitating engagement of said flange into said annular cavity, said facilitating means including:

(a) formation of a plurality of bores in said main body of the clamping bearing sleeve member, whereby a latticed half portion of said clamping bearing sleeve member is achieved; and (b) said clamping bearing sleeve member main body being made of a sturdy resilient material.

8. A paint roller bearing support as defined in claim 1, wherein said end cap roller member is substantially shorter than said clamping bearing sleeve member.

* * * * *